US006471288B2

(12) United States Patent
Alexander, Jr.

(10) Patent No.: US 6,471,288 B2
(45) **Date of Patent: *Oct. 29, 2002**

(54) CONTINUOUSLY ADJUSTABLE LAWN FURNITURE WITH FLEXIBLE SEAT

(76) Inventor: John G. Alexander, Jr., 4303 Ingham Ave., Columbus, OH (US) 43214

( * ) Notice: Subject to any disclaimer, the term of this patent is extended or adjusted under 35 U.S.C. 154(b) by 0 days.

This patent is subject to a terminal disclaimer.

(21) Appl. No.: 09/915,039

(22) Filed: Jul. 25, 2001

(65) Prior Publication Data

US 2002/0021037 A1 Feb. 21, 2002

Related U.S. Application Data

(60) Provisional application No. 60/220,626, filed on Jul. 25, 2000.

(51) Int. Cl.[7] ..... A47C 4/16

(52) U.S. Cl. ..... 297/56; 297/19; 297/344.8; 108/144.11; 248/188.2; 248/188.5

(58) Field of Search ..... 297/19, 56, 325, 297/344.18, 463.1, 344.12; 248/188.2, 188.5; 108/1, 144.11, 147.19

(56) References Cited

U.S. PATENT DOCUMENTS

| | | | | | |
|---|---|---|---|---|---|
| 56,410 | A | * | 7/1866 | Harrison | 297/52 |
| 282,182 | A | * | 7/1883 | Flammang | 248/189.5 |
| 1,178,264 | A | * | 4/1916 | Rhodes | 297/52 |
| 4,772,068 | A | * | 9/1988 | Gleckler et al. | 297/39 |

* cited by examiner

*Primary Examiner*—Peter R. Brown
(74) *Attorney, Agent, or Firm*—James R. Eley, Esq.; Thompson Hine LLP

(57) ABSTRACT

A folding chair having adjustable rear legs for use on flat, even ground and in addition, on sloping terrain from about zero degrees to twenty degrees and being continuously adjustable over this range by a user in a seated position.

4 Claims, 5 Drawing Sheets

CONTINUOUSLY ADJUSTABLE LAWN FURNITURE WITH FLEXIBLE SEAT

BACKGROUND OF INVENTION

This application claim benefit of U.S. Provisional Patent Application No. 60/220,626, filed Jul. 25, 2000.

This invention relates to rugged, yet lightweight, outdoor furniture that is continuously adjustable to accommodate varying terrain.

Spectators of various outdoor events, such as golf, baseball, soccer, fireworks displays and parades, for example, typically use lawn furniture for seating during the event. Seating is commonly placed on nearby grass areas that may or may not be flat. A broad range of portable, folding and compact outdoor furniture is available in today's market but their designs are optimized for level or horizontal surfaces. The chairs are not the problem. Rather it is the way the various portable chairs are used on sloping ground.

Depending on the angle of the ground or slope, the seat of most chairs remains roughly parallel (actually around 6?? relative to the ground upon which it is situated. As the slope of the ground increases, the angle of an individual's seated position relative to horizontal decreases. As the seating angle decreases (to below 0°), the seated individual's constant attempt to brace himself to keep from sliding out of the chair or to keep the chair from toppling does not create a situation of relaxed comfort, the goal of sitting in a chair in the first place. At some point of discomfort, individuals with nothing more than a fixed-leg lawn chair will elect to sit on the ground or try to find flatter ground for their chairs rather than fight the slope.

Unfortunately, flatter ground simply may not be available or may offer an inferior viewing perspective of the event being observed.

In order to compensate for various slopes, the legs of a chair must be easily and continuously adjustable to adapt to a wide degree of slopes in order to maintain a somewhat normal and comfortable seating angle. In addition, since a portable chair may be subject to rules and restrictions at certain spectator events, a chair's capacity to adapt to sloping terrain seating may be subject to certain physical limitations. For example, the rules covering portable seating at the Memorial Golf Tournament held at the Muirfield Village Golf Club in Dublin, Ohio prohibit, among other things, chairs with arms and chairs over a certain height.

Several attempts to solve this seating problem have resulted in patents being granted patents for adjustable portable chairs. However, as will be evident from the discourse below, each of these attempts have shortcomings, which prevent them from fully achieving a solution to the slope problem.

For example, U.S. Pat. No. 4,772,068, issued to Glecker et al., discloses a portable fishing chair intended for use on sloping terrain by fishermen and campers. Glecker et al.'s chair employs and adjustable extension, which is limited to three fixed positions, which accommodates only three different degrees of slope. The chair is not easily adjustable from the multiple, fixed seating positions and appears relatively complicated. In addition, the chair has arms, which would prevent it from being used at certain events.

U.S. Pat. No. 5,494,333, issued to Wilson, discloses a chair, which provides either three or four individually adjustable legs such that the chair can be used on a variety of terrain. Like Glecker et al. the number of positions is fixed and thus cannot conform continuously to a wide degree of slopes. The legs do not appear to be easily adjustable by a user in a seated position. Like the Glecker chair, the Wilson chair has arms and thus would not conform to events where armed chairs are not permitted.

U.S. Pat. No. 5,522,642, issued to Herzog, discloses a folding stool, with individually adjustable legs, that is adaptable for use on various sloped terrains. However, like the other chairs in the cited art, the legs are not adjustable from a seated position and adjustment is limited to a fixed number of angles based upon predetermined, fixed hole spacings. While Herzog has no arms, its ability of increasing the height of the stool for better viewing over crowds would violate chair policies for events, which regulate the maximum allowable seat height for portable seating.

U.S. Pat. No. 6,036,148, issued to Shank, discloses a folding outdoor chair having four, independently adjustable legs. However, like the other chairs in the cited art, the legs do not appear to be easily adjustable from a seated position and would require multiple settings of the various legs.

What is needed is a sturdy, durable and portable lawn chair that has a comfortable seat and which can be easily adjustable to varying terrain from a seated position.

SUMMARY OF THE INVENTION

The present invention provides:

A chair for maintaining a normal seated position on flat, horizontal ground continuously up to twenty degree grades or slopes by utilizing a quick and sturdy rear leg leveling adjustment;

A portable chair that has a comfortable and flexible seat;

A chair that is easily adjustable from a seated position;

Solid construction, high quality materials, lightweight and portable;

A portable chair that folds flat for storage and easy portage;

A portable chair designed within specified limitations on chair seat height and width and chair back height for select events prohibiting certain chairs, i.e., lawn chairs, solid chairs and chairs with arms;

A portable chair that can be used on flat ground in addition to sloped terrain; and A portable chair with suitability for commercial and rental applications with sleek look, durability, function and design.

Another feature of one aspect of the invention is to provide a folding chair having adjustable legs for use on flat, even ground and in addition, on sloping terrain from about zero degrees to twenty degrees continuously comprising front leg assembly having two leg members with a first, upper fixed horizontal cross support to support a portion of a seating material. A lower fixed horizontal cross brace is located near the bottom of the leg members, and a back support assembly is pivotally attached to the upper rear leg assembly. The back support assembly is comprised of: two parallel sides pivotally attached at one end to the outer sides of the front leg assembly; a horizontal back support member connected between the upper extents of said two parallel sides and providing a user with back support when unfolded; and a lower horizontal stop member located near the lower extents of said parallel sides providing for a predetermined angle of said back support when unfolded. Also included is an upper rear leg assembly consisting of two leg members attached near their upper extents by a second, fixed horizontal cross support to support a portion of said seating material, a horizontal cross brace fixed near the bottom of the legs. C-type structural channel are provided and fixed to the rear facing surface of each upper rear leg to slidably receive at least one channel slide member. A lower rear leg assembly is also provided and consists of: two lower leg members, each containing two channel slide members, one of which is slidably fixed within the upper portion of each of said channels and the other being attached to a screw-type knob, providing for positioning adjustment of said lower leg members with respect to said upper rear leg members and having two horizontal cross braces, one fixed between and near the tops of the leg members and the other near the bottom of the leg members. This aspect of the invention also includes a seat consisting of a seating material suspended between the first and second upper fixed horizontal cross supports. The seating material is comprised of a flexible material, which can be either natural or man-made.

These and other features, aspects and advantages of the present invention will become better understood with the regard to the following description, appended claims and accompanying drawings.

DETAILED DESCRIPTION OF DRAWINGS

DETAILED DESCRIPTION OF THE INVENTION

Figure 1:
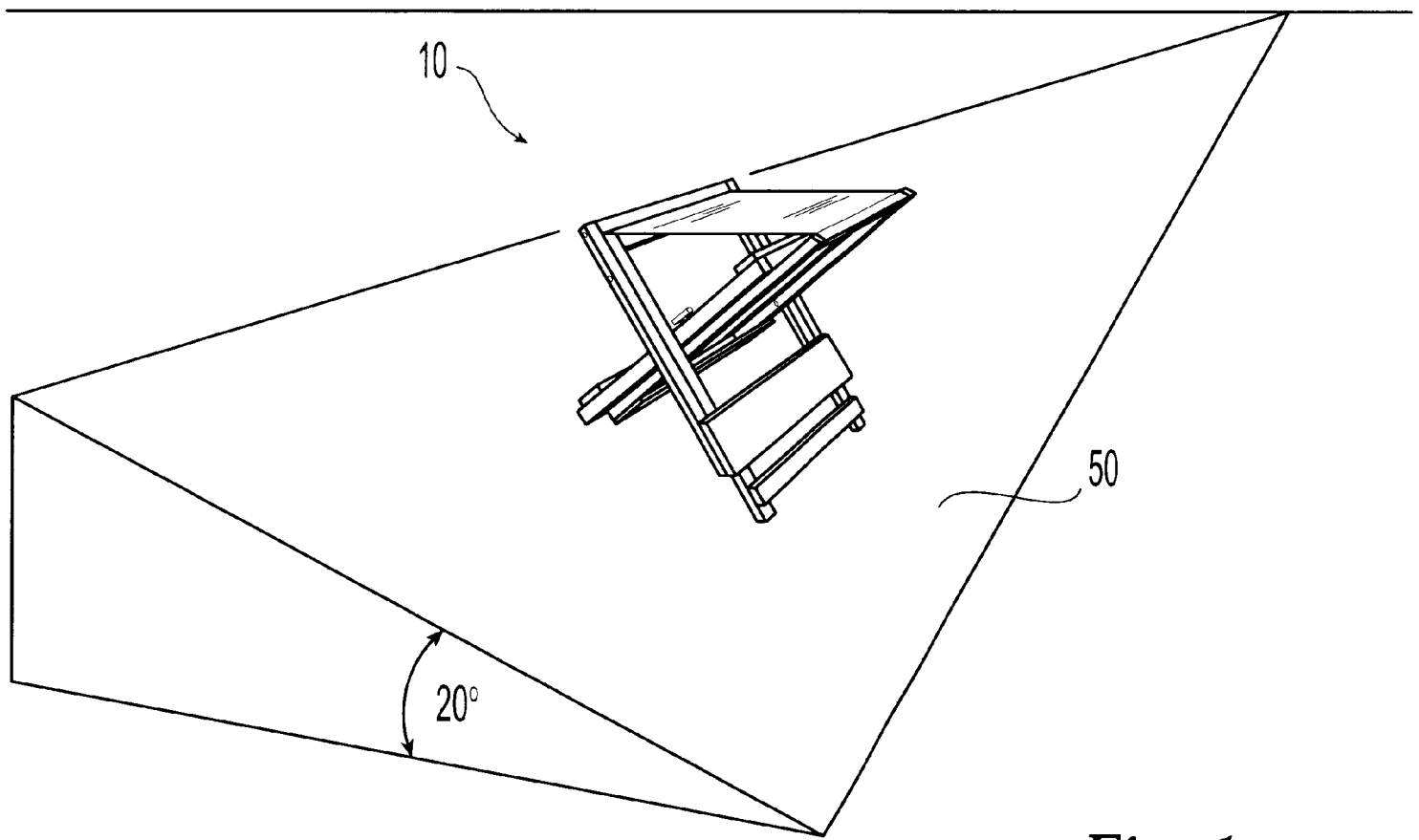
FIG. 1 is a perspective view of one embodiment of the claimed invention shown on a twenty-degree slope.
Figure 2:
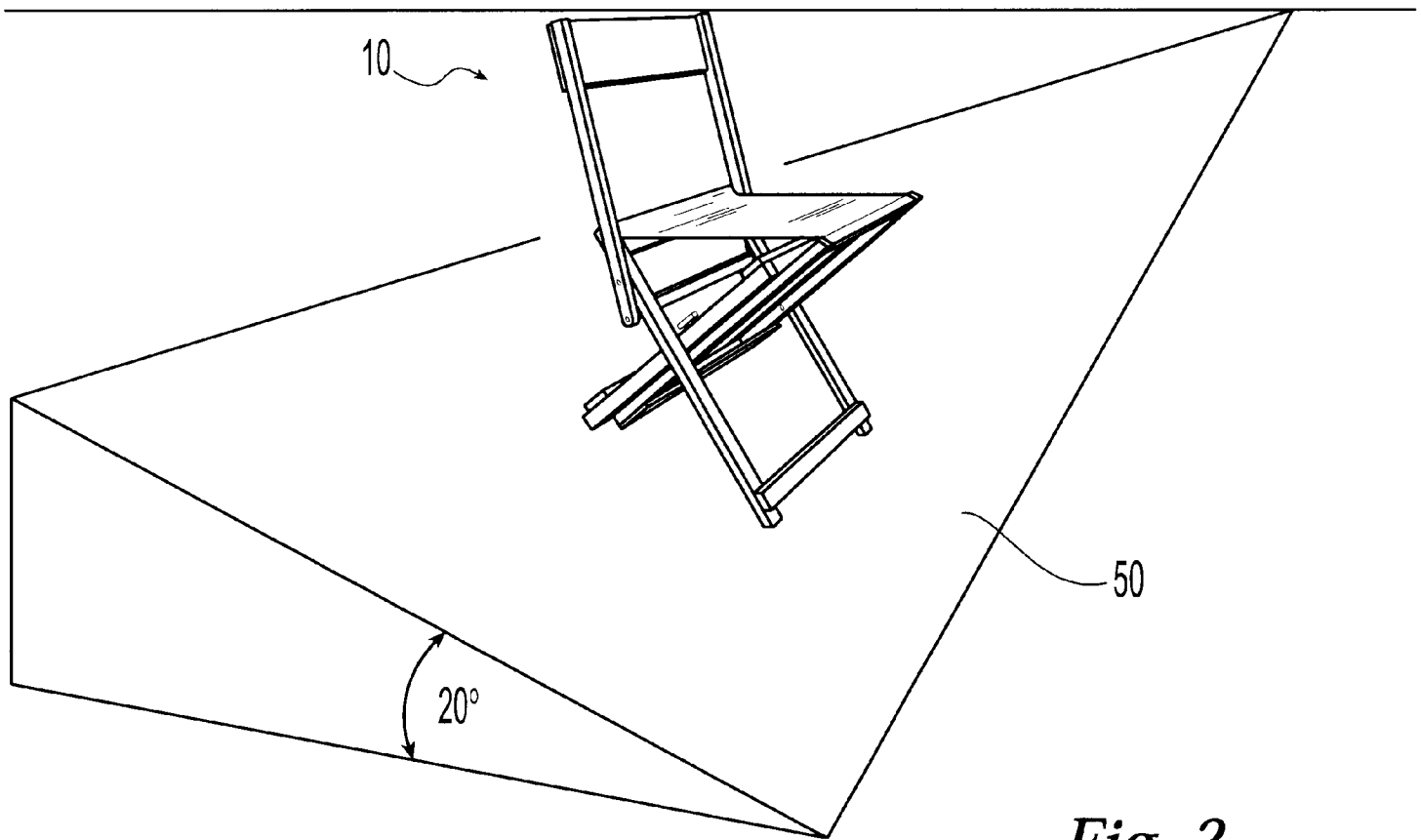
FIG. 2 is a perspective view of one embodiment of the claimed invention with the back support fully unfolded on a twenty-degree slope.
Figure 4:
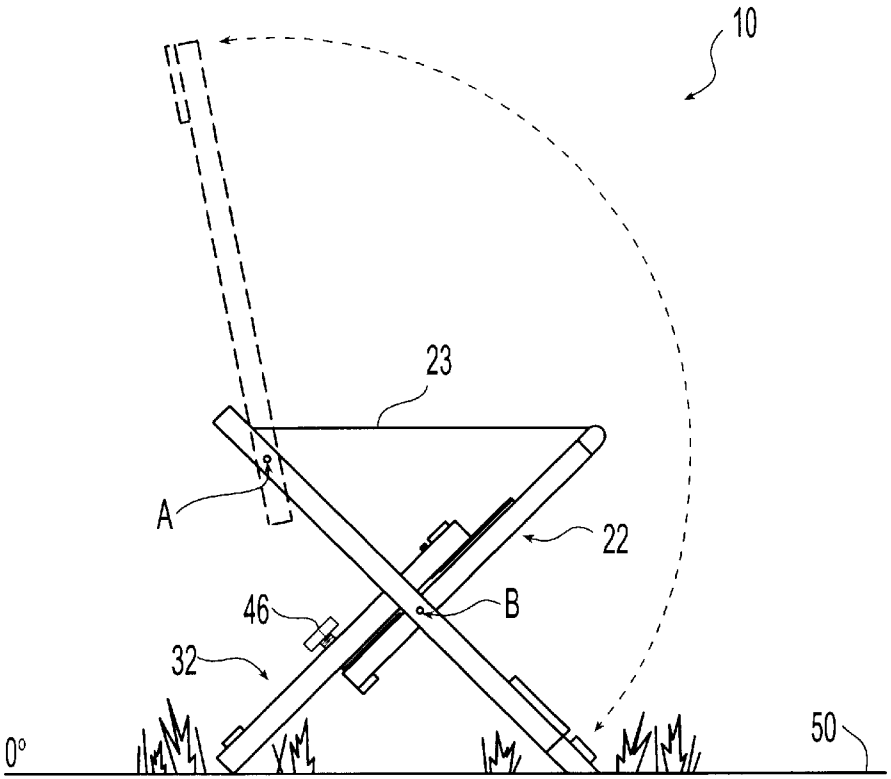
FIG. 4 is a side elevational view of one embodiment of the claimed invention with the back support folded on level ground.
Figure 3:
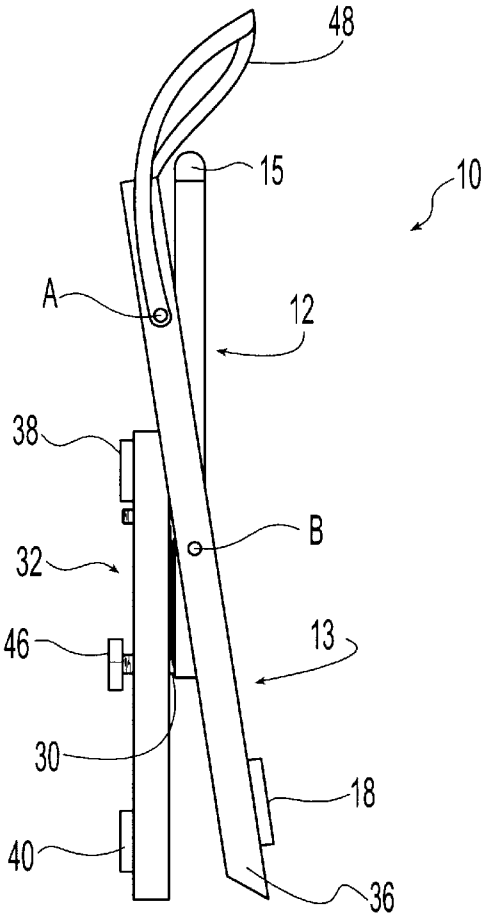
FIG. 3 is a side elevational view of one embodiment of the claimed invention nearly fully folded for storage or portage.
Figure 5:
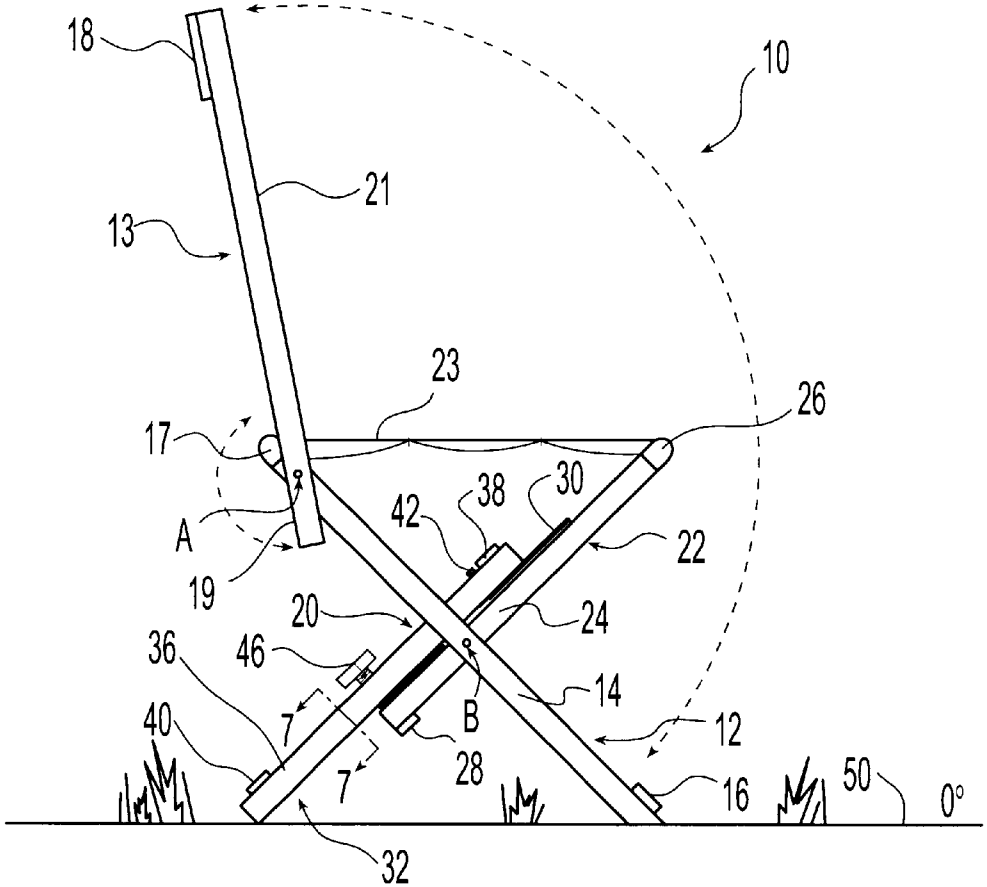
FIG. 5 is a side elevational view of one embodiment of the claimed invention with the back support fully unfolded on level ground.
Figure 7:
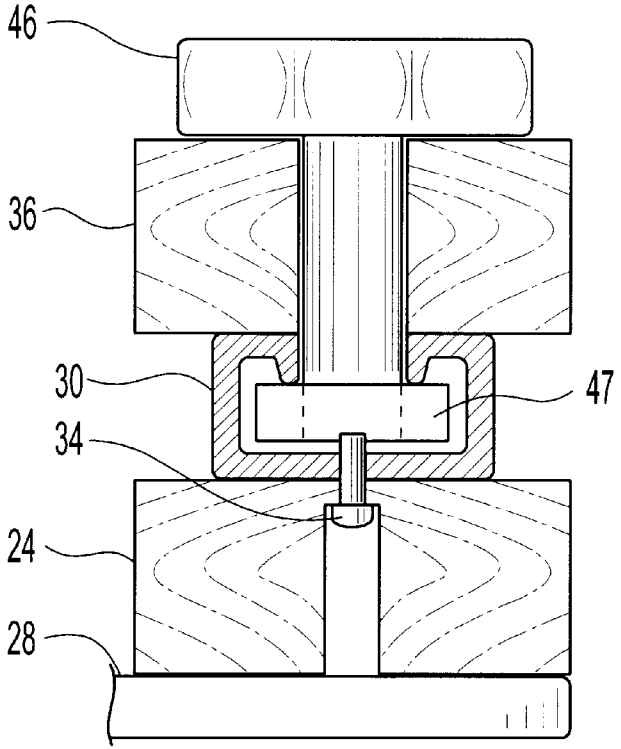
FIG. 7 is a cross section 7—7 of rear leg assembly showing adjustable slide components.

Referring to FIG. 5, a folding chair 10 according to a first embodiment of the present invention is shown. The front leg assembly 12 consists of two front parallel leg members 14, 14' (not shown) extending to the height of the seat and being permanently connected together at the bottom by a horizontal cross brace 16 and at the top by a horizontal cross support 17. The lower horizontal cross brace 16 may be fixed nominally one inch above the bottom of the front leg members 14, 14' in order to provide a solid foot rest, and to limit the amount the legs penetrate soft ground 50. The upper horizontal cross support 17 strengthens and stabilizes the front leg assembly 12 and provides support and a means for attaching the rear portion of the seat material 23.

Pivotally attached to the front leg assembly 12 is the back rest assembly 13 consisting of two parallel sides 21, 21' (not shown) that are movably retained as at point "A" toward the lower extent of one end to the outer sides of the front leg assembly 12 and the other end by a horizontal back support 18, which further strengthens and stabilizes the chair and provides sufficient back support when fully unfolded. Details of the pivoting mechanism is not shown, but may consist of a number of various nut and bolt arrangement, as would be appreciated and understood by one skilled in the art. A lower horizontal cross brace 19 (shown in phantom) may be supplied to provide structural stability and a physical stop for the backrest assembly against the front leg members 14, 13' when fully unfolded. Alternately, horizontal cross support member 17 may be constructed to extend beyond the width of the front leg members 14, 14', to provide a back rest stop when engaging rearward faces of parallel sides 21 and 21'.

The rear leg assembly 20 consists of two separate sub-assemblies. The upper or forward rear assembly 22 comprises two forward rear assembly leg members 24, and 24' (not shown) that are pivotally attached in a conventional manner, as at point "B", to the front leg assembly 12. To provide stability, a cross brace 28 is fixed horizontally near the bottom of and between the two forward rear assembly leg members 24, 24' and at the top by a fixed, horizontal cross support 26, which also provides support and means for attaching the front portion of seat material 23. Attached to the rear facing surfaces of the fixed rear assembly leg members 24, 24' are slotted "C" channels 30, 30', such as may be commercially available as UNISTRUT™. A lower stop mechanism 34 is provided within each channel 30, 30', at about their lower extents, to prevent the lower rear leg assembly 32 from completely disengaging the channels during adjustment of adjusting knob 46. The lower stop mechanism 34 is positioned to provide a user with a chair that sits on a horizontal, i.e. 0.degree., surface when the lower leg assembly is fully extended. A similar arrangement interacting with upper stop member 42 prevents over travel of the sliding leg members 36,36 ' in the opposite direction.

Figure 6:
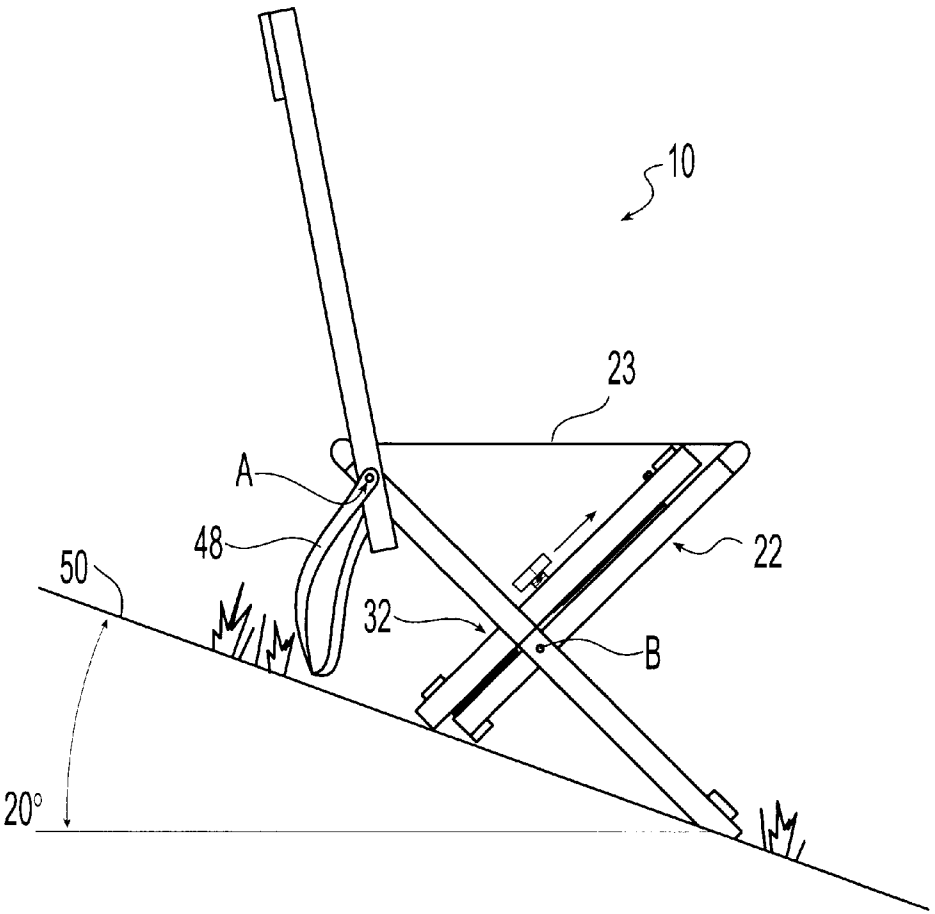
FIG. 6 is a side elevational view of one embodiment of the claimed invention with the back support fully unfolded on a twenty-degree slope.

The lower rear leg assembly 32 comprises two vertical leg members 36 and 36', which are permanently connected by an upper cross brace 38 and lower cross brace 40. The lower cross brace 40 is fixed approximately one inch above the bottom of the leg members 36, 36 ' to provide structural stability and to limit the amount the ends of the leg members penetrate soft ground 50. In addition, each lower rear leg member 36, 36' has an upper channel slide member 42 located near the tops of the respective leg members and an adjustable, lower channel slide member 47 secured with an adjusting knob 46, each channel slide member having a head porting slidably engaged within the flanges of the slotted "C" channels, 30, 30'. Loosening and then tightening adjustable knob 46 enables engagement between the upper rear leg assembly 22 and the lower rear leg assembly and provides for variable and easy adjustment of the angle of the chair by the user while in a seated position (see also FIG. 6). Referring additionally to FIG. 6, the folding chair 10 is shown with the lower rear leg assembly 32 in a nearly fully retracted position to accommodate a 20.degree. slope. Carrying strap 48 may be provided, preferably attached at its ends to pivot point "A". So attached, when the rear leg assembly is in the retracted position, the chair will automatically collapse under the force of gravity, into its fully folded, carrying configuration.

The seat material 23 preferably consists of natural and/or man-made fabric or other suitable material which is attached to the front leg assembly's top horizontal cross support 17 and the rear leg assembly's top cross supports 15, 23, which when unfolded, provides a sturdy, yet flexible and comfortable seat which has been weight tested to 260 pounds. The seat material 23 may be secured to cross supports 15 and 23 with fasteners, such as nails, screws, staples or the like or sewn with loops on the front and rear portions to accommodate the cross supports passing through the loops without being securely fastened.

The chair 10 in FIG. 5 is preferably constructed from any combination of metal, wood, composite materials, or molded from a variety of suitable plastic material and includes a flexible seat 23, preferably manufactured from canvas, or other woven fabric, plastic, or other flexible and durable material.

It is to be understood that while certain forms of the present invention have been illustrated and described herein, it is not to be limited to the specific forms or arrangements of parts described and shown.

I claim:

1. A folding chair having adjustable legs for use on flat, even ground and in addition, on sloping terrain from about zero degrees to twenty degrees continuously comprising:

a front leg assembly consisting of:

two leg members with a first, upper fixed horizontal cross support to support a portion of a seating material, a lower fixed horizontal cross brace located near the bottom of the leg members, a back support assembly being pivotally attached to the front leg assembly, said back support assembly comprising:

two parallel sides pivotally attached at one end to the outer sides of the front leg assembly, a horizontal back support member connected between the upper extents of said two parallel sides and providing a user with back support when unfolded, an upper rear leg assembly consisting of:

two leg members attached near their upper extents by a second, fixed horizontal cross support to support a portion of said seating material, a horizontal cross brace fixed near the bottom of the legs, a C-type structural channel fixed to the rear facing surface of each upper rear leg to slidably receive at least one channel slide member, a lower rear leg assembly consisting of:

two lower leg members, each containing two channel slide members, one of which is slidably fixed within the upper portion of each of said channels and the other being attached to a screw-type knob, providing for positioning adjustment of said lower leg members with respect to said upper rear leg members, a horizontal cross brace fixed between and near the tops of the leg members, and a seat consisting of a seating material suspended between said first and second upper fixed horizontal cross braces, said material comprising a flexible material.

2. The folding chair of claim 1 wherein seating material is comprised of natural fabric.

3. The folding chair of claim 1 wherein said seating material is comprised of man-made material.

4. The folding chair of claim 1 additionally comprising a carrying strap connected at a pivot point between said front leg assembly and said back rest assembly for carrying said chair when in its folded configuration.

* * * * *